US005893378A

United States Patent [19]

Llerena

[11] Patent Number: 5,893,378

[45] Date of Patent: Apr. 13, 1999

[54] SMART TRAVELER

[76] Inventor: Judith A. Llerena, 2145 Mansfield Rd., Toledo, Ohio 43613

[21] Appl. No.: 09/138,396

[22] Filed: Aug. 24, 1998

[51] Int. Cl.[6] ..... A46B 11/02

[52] U.S. Cl. ..... 132/311; 132/308; 401/195; 401/268

[58] Field of Search ..... 132/311, 308, 132/309; 401/268, 132, 123, 124, 125, 195, 156, 184, 280

[56] References Cited

U.S. PATENT DOCUMENTS

| | | | |
|---|---|---|---|
| 3,879,139 | 4/1975 | Dahl et al. . | |
| 4,251,897 | 2/1981 | Alam . | |
| 4,865,481 | 9/1989 | Scales | 132/308 |
| 5,144,712 | 9/1992 | Hansel et al. . | |
| 5,150,495 | 9/1992 | Discko, Jr. et al. . | |
| 5,304,009 | 4/1994 | Marshall | 132/309 |
| 5,490,530 | 2/1996 | Snowden | 132/311 |
| 5,769,553 | 6/1998 | Chaudhri et al. | 401/195 |

*Primary Examiner*—Gene Mancene
*Assistant Examiner*—Pedro Philogene
*Attorney, Agent, or Firm*—Patent & Trademark Services; Joseph H. McGlynn

[57] ABSTRACT

A device for oral hygiene which is a disposable assembly and comprises a toothbrush with a quantity of dentifrice packed into the bristles. The toothbrush has a hollow handle for storing a quantity of antiseptic mouthwash. The mouthwash may be accessed by breaking away a plug from the bottom of the handle. A toothpick is contained in a slot on the handle, and a strand of dental floss is strung longitudinally down the handle. The toothpick and dental floss are attached to the handle by a strip of sanitary tape.

7 Claims, 1 Drawing Sheet

SMART TRAVELER

BACKGROUND OF THE INVENTION

The present invention relates generally to products for maintaining oral hygiene, and in particular to a disposable assembly comprising a variety of oral hygiene implements, including a toothbrush, oral dentifrice, dental floss, mouthwash, and toothpick.

DESCRIPTION OF THE PRIOR ART

It is well known that proper oral hygiene is a necessary component of good health. However, while most people have ample supplies available at home to maintain proper oral hygiene, they find it inconvenient to transport these items while away from home for short periods. Thus, people tend to practice less-than-optimal oral hygiene while at work, in school, or on short trips.

Several disposable toothbrushes have been disclosed in an attempt to enable users to improve their daily oral hygiene. For example, U.S. Pat. No. 5,144,712 describes a disposable toothbrush having a tubular housing and a telescopically slidable brush carrier mounted therein.

U.S. Pat. No. 4,251,897 discloses a disposable toothbrush assembly adapted to fit over the finger of a user, having in one aspect a cavity containing an oral dentifrice.

U.S. Pat. No. 5,150,495 describes a disposable dental brush having a brush end that may be disposed at various angles relative to the handle portion.

U.S. Pat. No. 3,879,139 discloses a disposable toothbrush assembly with a hollow brush end for communicating a quantity of oral dentifrice to the bristles.

While the prior art has disclosed a number of disposable implements for brushing the teeth, however, these inventions have failed to provide the user with the means to accomplish other necessary components of oral hygiene. Flossing and rinsing with an antiseptic, for example, are extremely important aspects of proper oral care. The present invention, described in detail below, provides a disposable oral hygiene assembly that provides the means for accomplishing complete dental hygiene in a convenient, disposable assembly.

SUMMARY OF THE INVENTION

The present invention provides a discrete, disposable oral hygiene assembly that provides the user with the ability to brush, floss, rinse, and remove food particles from the teeth. The invention comprises a toothbrush having an elongated handle portion and a set of bristles at one end thereof. The bristles contain a pre-measured portion of dentifrice sufficient for a single brushing. The handle itself is hollow, forming a cavity for containing a small amount of antiseptic mouthwash, also sufficient for a single use. The mouthwash may be accessed by twisting off a cap at the distal end of the handle to expose a small opening which will allow the user to sip out the mouthwash. The invention further comprises a length of dental floss threaded between the bristles and attached to the handle by means of sanitary tape. The handle further comprises an indentation for holding a toothpick, which is also held in place by the length of sanitary tape. The present invention may be packaged in individual, sanitary wrappers for easy storage and transportation. In use, the invention provides a convenient, inexpensive, and effective implement for maintaining proper oral hygiene at all times.

Accordingly, it is an object of this invention to provide an improved device for maintaining proper oral hygiene.

It is a further object of this invention to provide a device for oral hygiene that is inexpensive, convenient, and disposable.

It is still further an object of this invention to provide a device for oral hygiene that is compact and effective.

It is still further an object of this invention to provide a device for oral hygiene that provides means for accomplishing a variety of tasks related to oral hygiene.

It is still further an object of this invention to provide a device for oral hygiene that comprises a toothbrush, dental floss, mouthwash, toothpaste and a toothpick in a discrete, sanitary assembly.

These and other objects and advantages of the present invention will become apparent from the detailed description below, when taken in conjunction with annexed drawings.

DESCRIPTION OF THE PREFERRED EMBODIMENT

Figure 1:
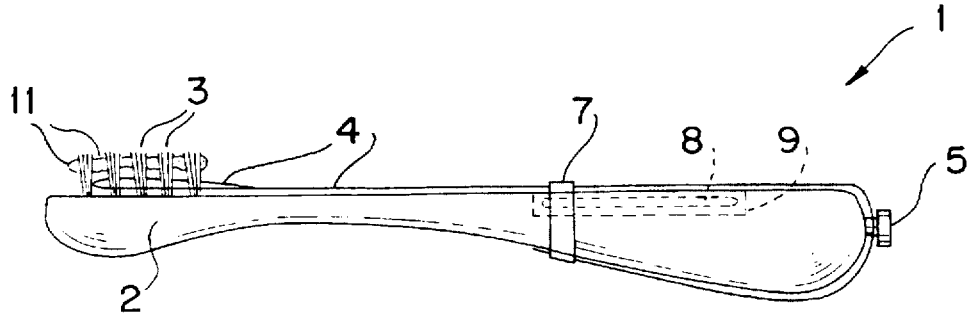
FIG. 1 shows a side view of the oral hygiene assembly of the present invention.
Figure 3:
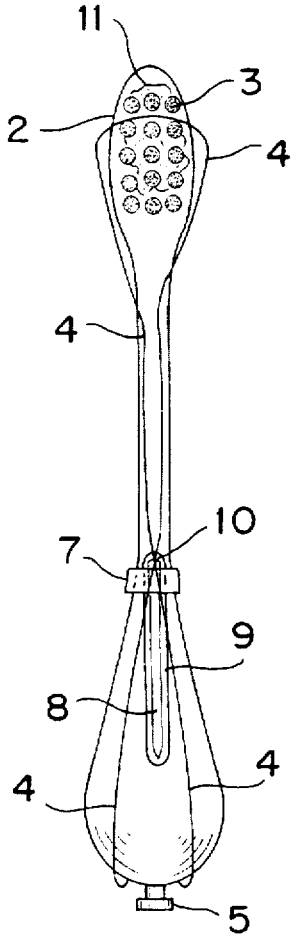
FIG. 3 shows a front view of the oral hygiene assembly of the present invention.
Figure 2:
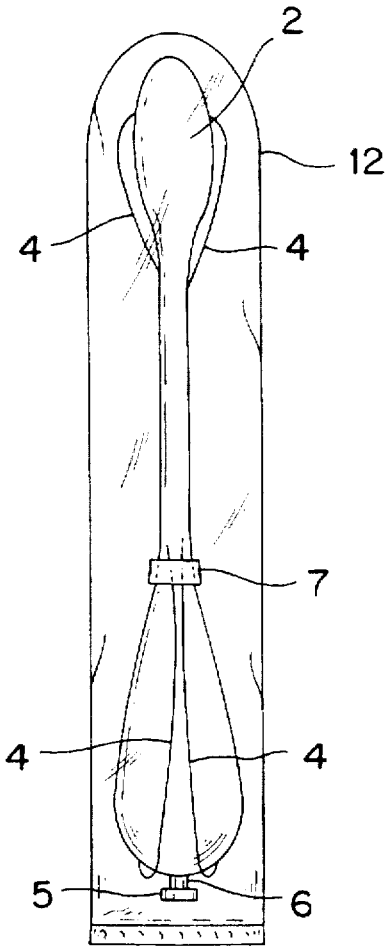
FIG. 2 shows a back view of the oral hygiene assembly of the present invention.

Referring now to the drawings in greater detail, the oral hygiene assembly 1 of the present invention is depicted in a side view in FIG. 1 generally comprising an elongated handle portion 2, with bristles 3 extending normally from one end of the handle 2, and a plug 5 with threads 6 inserted longitudinally into the opposite end thereof. The handle 2 is preferably constructed from hollow, molded plastic, forming a cavity for the storage of a quantity of antiseptic mouthwash sufficient for a single use. As shown in FIGS. 3 and 2, showing the front and back view, respectively, the bottom portion of the handle 2 has a slight lateral bulge at 13 to enhance its storage capacity. In the preferred embodiment, the handle 2 should have an internal cavity sufficient to store approximately 0.5 fluid ounces of antiseptic mouthwash.

The bristles 3 are preferably constructed from thin portions of flexible plastic commonly used in the construction of toothbrushes, although any type of conventional bristles can be used. The bristles 3 are permanently affixed to the upper head of the handle 2 in the molding process, and are preferably arranged into columns, as shown in both FIGS. 1 and 3. As shown in FIG. 1, the bristles 3 are packed with a layer of dentifrice 11, such as a fluoride toothpaste, in an amount sufficient for a single use. The dentifrice 11 is preferably packed into a layer approximately midway up the length of the bristles 3, such that the dentifrice 11 efficiently saturates the bristles 3 when mixed with water.

As shown in FIGS. 1, 2, and 3, a removable tab or plug 5 is inserted into the bottom of the handle 2. The plugs will be molded directly to the handle 2 after the mouthwash is inserted into the handle. In order to access the quantity of antiseptic mouthwash stored in the internal cavity of the handle 2, the tab or plug 5 will be twisted with respect to the handle and the narrow neck portion 6 will allow the tab or plug 5 to be broken away from the handle 2 exposing a small hole in the handle which will allow the user to sip out the mouthwash.

As depicted by the shadow lines in FIG. 1, the handle 2 further has thereon a longitudinal indentation 9 (see also FIG. 3), positioned approximately midway between the bristles 3 and the plug 5. The indentation 9 provides a slot for the storage of a toothpick 8. A strip of sanitary tape 7 is wrapped around the handle 2 to retain the toothpick 8 within the indentation 9, said tape being easily removable to access the toothpick 8.

As shown in FIGS. 1, 2 and, 3 taken together, the oral hygiene assembly 1 further comprises a length of dental floss 4 attached longitudinally to the handle 2. As shown best in FIG. 3, the dental floss 4 is strung transversely around the base of the bristles 3. The opposing strands of the floss 4 extend longitudinally down the length of the handle 2, crossing each other at 10. As shown particularly in FIG. 4, the dental floss 4 further extends around the bottom edge of the handle 2, and terminates approximately midway up the back side of the handle 2. The dental floss 4 is secured at its middle and end portions to the handle 2 by the aforementioned strip of sanitary tape 7. The floss 4 also helps to hold the toothpick 8 within the cavity 9.

The usefulness of the oral hygiene assembly of the present invention may now be appreciated. On use, the invention provides a convenient, inexpensive, and discrete device that allows the user to accomplish complete oral hygiene when away from home. The invention obviates the need to transport toothbrushes, toothpaste, mouthwash, dental floss, and other items separately. The oral hygiene assembly 1 is thus ideal for use at work, in school, or on vacations and business trips. The oral hygiene assembly 1 may be individually packaged in any conventional sanitary wrapping 12, as shown in FIG. 2, to further enhance convenience and transportability.

Although the oral hygiene assembly and the method of using the same according to the present invention have been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A oral hygiene assembly comprising:

a handle, said handle having a first end and a second end, and a front surface and a back surface, said handle having a plurality of bristles on said first end, at least a portion of said handle being hollow, said handle having an aperture on said second end and means for closing said aperture, said handle having an indentation on one of said front or back surfaces, said indentation being positioned approximately midway between said first and second ends, and dental floss attached to said handle.

2. The oral hygiene assembly as claimed in claim 1, wherein a toothpick is secured within said indentation.

3. The oral hygiene assembly as claimed in claim 1, wherein toothpaste is secured to said bristles.

4. The oral hygiene assembly as claimed in claim 1, wherein said means for closing said aperture is a plug which is integrally attached to said handle and can be broken away from said handle.

5. The oral hygiene assembly as claimed in claim 1, wherein said dental floss is secured to said handle by a loop of dental floss which is passed through said bristles, then passed around said second end of said handle and secured to said back surface of said handle.

6. The oral hygiene assembly as claimed in claim 5, wherein said dental floss is secured to said back surface by tape.

7. The oral hygiene assembly as claimed in claim 5, wherein a cover completely encloses said oral hygiene assembly.

* * * * *